US007342208B2

(12) United States Patent
Kang et al.

(10) Patent No.: US 7,342,208 B2
(45) Date of Patent: Mar. 11, 2008

(54) LINEARLY RECIPROCATING TRAY FOR MICROWAVE OVEN

(75) Inventors: Jeon Hong Kang, Yongin-Si (KR); Sang Jin Jeong, Yongin-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 169 days.

(21) Appl. No.: 11/289,427

(22) Filed: Nov. 30, 2005

(65) Prior Publication Data

US 2007/0007283 A1 Jan. 11, 2007

(30) Foreign Application Priority Data

Jul. 7, 2005 (KR) ..... 10-2005-0061338

(51) Int. Cl.
*H05B 6/78* (2006.01)

(52) U.S. Cl. ..... 219/754; 219/752; 219/762; 126/388

(58) Field of Classification Search ..... 219/752–755, 219/762–763; 126/388
See application file for complete search history.

(56) References Cited

U.S. PATENT DOCUMENTS 6,512,213 B2 * 1/2003 Choi ..... 219/754
2005/0016998 A1 * 1/2005 Choi ..... 219/754

FOREIGN PATENT DOCUMENTS

| | | |
|---|---|---|
| KR | 2005-8095 | 1/2005 |
| KR | 2005-12410 | 2/2005 |
| KR | 2005-12529 | 2/2005 |

* cited by examiner

*Primary Examiner*—Philip H. Leung
(74) *Attorney, Agent, or Firm*—Staas & Halsey LLP

(57) ABSTRACT

A microwave oven in which there is substantially no difference between time when a linearly traveling tray travels from the right side to the left side of a cooking chamber and time when the linearly traveling tray stays at the right side or the left side. The microwave oven includes a linearly traveling tray having a guide channel or hole guiding a linear movement and a power transmission transmitting driving power of a motor to the tray. The guide channel and the guide hole have an oval shape and adjust the staying time at the rightmost or leftmost side in the traveling region. A rotation tray having a locking step formed in the lower surface thereof is further provided. The power transmission may include a linkage, protrusion and/or a roller, and their modifications. Food is uniformly cooked at any place of the cooking chamber, and a user can easily clean and reinstall the tray.

4 Claims, 13 Drawing Sheets

LINEARLY RECIPROCATING TRAY FOR MICROWAVE OVEN

CROSS-REFERENCE TO RELATED APPLICATIONS

This application claims the benefit of Korean Patent Application No. 10-2005-0061338, filed on Jul. 7, 2005, in the Korean Intellectual Property Office, the disclosure of which is incorporated herein by reference.

BACKGROUND OF THE INVENTION

1. Field of the Invention

The present invention relates to a microwave oven, and more particularly, to a microwave oven including a rotary tray and a linearly reciprocating tray, which enable food to be uniformly cooked.

2. Description of the Related Art

Microwave ovens are cooking devices using electronic waves. A microwave oven projects microwaves to food to be cooked to vibrate water molecules in the food, and cooks the food using frictional heat generated between water molecules as heat for cooking the food.

When the microwaves are projected and reflected from the inner walls of a cooking chamber, traveling microwaves and the reflected microwaves are superposed, and the electromagnetic field formed within the microwave ovens exhibits strong and weak spots. Due to the inconsistent distribution of the electromagnetic field, food cannot be heated uniformly, so that food is imperfectly cooked. Thus, to avoid this phenomenon, food, i.e. an object to be cooked, is moved or the traveling direction of the microwaves is changed such that the microwaves are uniformly projected to the food if possible.

Among the conventional methods, the method of using a rotary tray is widely known. However, the method of using a rotary tray has disadvantages in that, when long food is placed on the rotary tray, the long food contacts the rear wall of the cooking chamber or the inner surface of a door so that the long food cannot be smoothly rotated and cooked. By taking this problem into consideration, a tray linearly reciprocating in the lateral direction is utilized. However, in comparison with the rotary tray, the linearly reciprocating tray has a limited ability to uniformly cook food.

Recently, a tray assembly using the rotary tray and the linearly reciprocating tray, an example of which is disclosed in Korean Patent Laid-Open No. 2005-12410, is under development.

The disclosed tray assembly is constructed such that an oval recess, i.e. a kind of rail, is formed on the bottom surface of a first tray, a first cam shaft rotated by a motor moves along the first recess, and the first tray linearly reciprocates. However, in the disclosed conventional tray assembly, since the first recess is configured to allow the first tray to swing from the left side to the right side, time when the first tray travels through the central area of a cooking chamber is longer than time when the first tray stays at the left or right side of the cooking chamber. Thus, since food is mostly cooked at the central area of the cooking chamber, food cannot be uniformly cooked.

Moreover, according to the conventional tray assembly, since the first camshaft inserted into the first recess travels along the first recess to move the first tray, the first camshaft tends to easily escape from the first recess unless the first recess is formed at a sufficient depth. In the conventional tray assembly, since an accommodating part for accommodating a second tray must be formed above the first tray and the first recess must be formed in the bottom surface of the first tray, there is a limit to the depth of the first recess.

Additionally, in the conventional tray assembly, since the first camshaft and a second camshaft are respectively inserted into the first recess of the first tray and a second recess of the second tray, the tray assembly is not easily assembled. Thus, the conventional tray assembly is inconvenient for a user to clean the bottom of the cooking chamber and to install the conventional tray assembly.

SUMMARY OF THE INVENTION

The present invention has been made in view of the above-mentioned problems, and an aspect of the invention is to provide a microwave oven in which there is substantially no difference between time when a linearly traveling tray travels from the right side to the left side of a cooking chamber and time when the linearly traveling tray stays at the right side or the left side, so that food is uniformly cooked at the central area and the right and left sides of the cooking chamber.

It is another aspect of the present invention to provide a microwave oven for preventing a linearly traveling tray from being separated from a power transmission, thereby securing operative stability of the linearly traveling tray.

It is yet another aspect of the present invention to provide a microwave oven for guaranteeing convenient installation of a tray assembly.

In accordance with one aspect, the present invention provides a microwave oven including a cooking chamber having a bottom plate, a tray linearly traveling on the bottom plate, a motor for generating driving power necessary for the travel of the tray, a power transmission for transmitting the driving power to the tray, and a guide channel protruded from the bottom surface of the tray to guide the linear travel of the tray, where the power transmission is rotated in the guide channel and contacts the inner surface of the guide channel to linearly move the tray in the right and left directions.

The guide channel may have an oval shape, and the power transmission may contact the guide channel in a region to move the tray in the right and left directions and freely move in the outside of the region. As such, when the power transmission moves freely, the tray does not move for a predetermined period of time and stops at the position where the tray is positioned.

The power transmission contacts the guide channel to move the tray to the rightmost side or to the leftmost side while rotating by 90 degrees, and freely moves while rotating by 90 degrees again.

The power transmission includes a linkage including an end coupled with a rotation shaft of the motor and the other end contacting the inner surface of the guide channel.

The linkage includes a roller installed at an end contacting the inner surface of the guide channel.

In accordance with another aspect of the present invention, the present invention provides a microwave oven including a cooking chamber having a bottom plate, a first tray having an accommodating part formed in an upper side thereof and linearly traveling on the bottom plate, a second tray rotatably installed in the accommodating part, a motor for generating driving power necessary for the movement of the first tray and the second tray, a power transmission for transmitting the driving power of the motor to the first tray and the second tray, and a guide hole formed in the intermediate portion of the accommodating part of the first tray to guide the linear movement of the first tray, where the power transmission is rotated within the guide hole and contacts the inner surface of the guide hole to linearly move the first tray in the right and left direction.

The guide hole may have an oval shape, and the power transmission may contact the guide hole in a region to move the first tray in the right and left direction and freely move in the outside of the region.

The power transmission contacts the guide channel to move the first tray to the rightmost side or to the leftmost side while rotating by 90 degrees, and freely moves while rotating by 90 degrees again.

The power transmission includes a linkage including an end coupled with a rotation shaft of the motor and the other end contacting the inner surface of the guide hole. Here, the linkage includes a roller installed at an end contacting the inner surface of the guide hole.

The second tray has at least one locking step formed in the lower surface thereof, the power transmission further includes a protrusion protruded from the linkage upward, and the protrusion contacts the locking step to transmit the driving power to the second tray. As a result, the first tray is linearly moved by the linkage, and simultaneously, the second tray is rotated by the protrusion. Here, a roller adopting the protrusion as a rotation shaft is installed at the protrusion.

The power transmission includes a linkage having an end coupled with a rotation shaft of the motor, and a protrusion protruded from the linkage upward, and the protrusion contacts the inner surface of the guide hole to transmit the driving power to the first tray. Here, a roller adopting the protrusion as a rotation shaft is installed at the protrusion.

The second tray includes at least one locking step formed in the lower surface thereof, and the protrusion contacts the locking step so that the power transmission transmits the driving power to the second tray. As a result, the first tray linearly travels due to the protrusion, and simultaneously, the second tray rotates. The protrusion includes a first roller contacting the inner surface of the guide hole, and a second roller contacting the locking step.

The second tray has at least one locking step formed in the lower surface thereof, the power transmission further includes a second protrusion protruded from the linkage upward, and the second protrusion contacts the locking step to transmit the driving power to the second tray. As a result, the first tray linearly travels due to the protrusion, and simultaneously, the second tray is rotated by the second protrusion. Here, the second protrusion includes a roller adopting the second protrusion as a rotation shaft.

Moreover, the microwave oven further includes guide rollers installed between the first tray and the bottom plate and between the second tray and the first tray to smoothly move the first tray and the second tray.

When the second tray is accommodated in the accommodating part, the upper side of the second tray is positioned lower than the upper side of the first tray.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
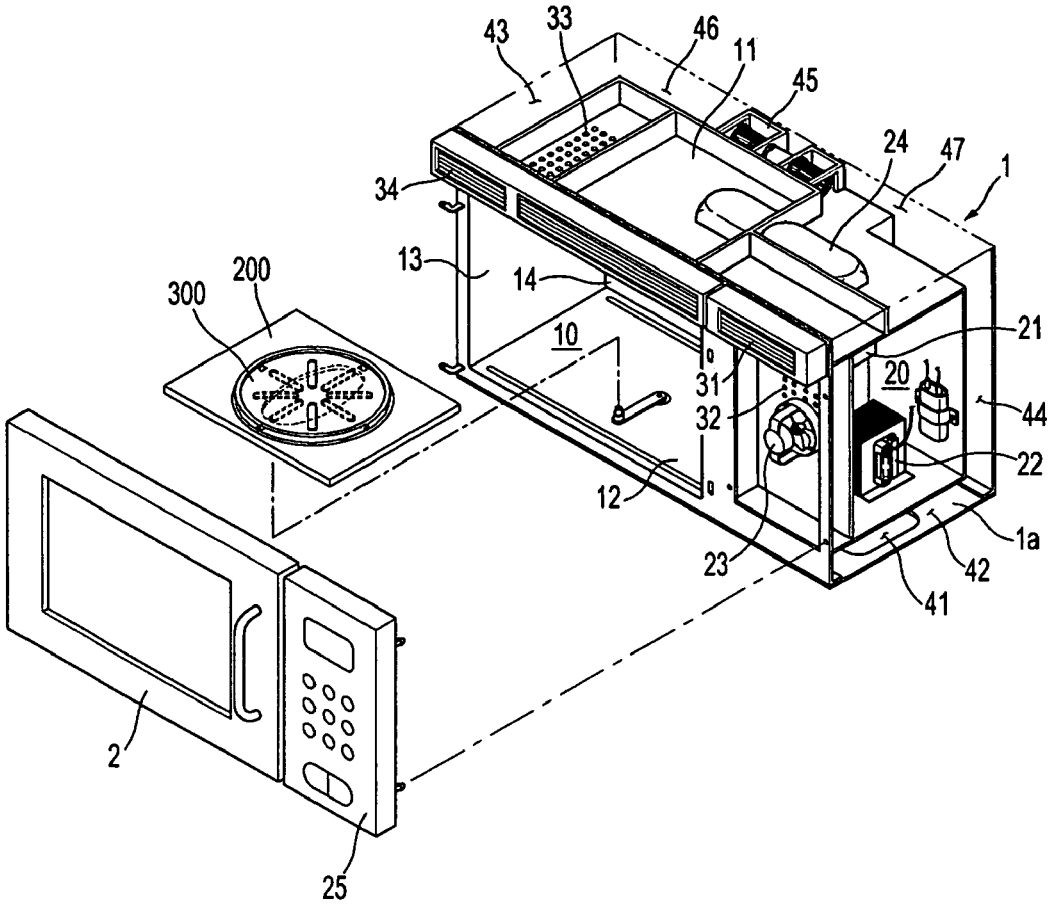
FIG. 1 is a perspective view illustrating the structure of a microwave oven according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, a wall-mounted type microwave oven will be described as an example. However, the present invention can be applied to general microwave oven. FIG. 1 is a perspective view illustrating the structure of a microwave oven according to an embodiment of the present invention.

As shown in FIG. 1, the microwave oven according to the preferred embodiment of the present invention is structured such that a cooking chamber 10 for cooking food and an electric device room 20 in which various electric devices are installed are placed in a main body 1 such that cooking chamber 10 and the electric device room may be distinguished.

The cooking chamber 10 is a cooking space defined by an upper plate 11, a bottom plate 12, side plates 13, and a rear plate 14 and has an opened front side. At a side of the main body 1, a door 2 for opening and closing the opened front side of the cooking chamber 10 is hinged.

In the electric device room 20, a magnetron 21 for supplying high frequency waves to the inside of the cooking chamber 10, a high voltage transformer 22 for applying high voltage to the magnetron 21, and a cooling fan 23 for cooling the inside of the electric device room 20. Moreover, at the upper sides of the electric device room 20 and the cooking chamber 10, a wave-guide 24 is installed to guide the high frequency waves supplied from the magnetron 21 to the cooking chamber 10, and at the front side of the electric device room 20, a control panel 25, in which a plurality of operation buttons for controlling various operation of the microwave oven and a display for displaying the operation state of the microwave oven are installed, is installed.

Moreover, the microwave oven according to an embodiment of the present invention includes a ventilation passage for cooling the electric device room 20 and ventilating the cooking chamber 10, and a discharging passage for discharging gas or smoke generated in a gas oven (not shown)

disposed at the lower side of the main body 1. Meanwhile, at the upper rear side of the main body 1, a discharging fan 45 is installed to discharge gas or smoke guided through the discharging passage to the outside of the microwave oven.

The ventilation passage includes a front suction port 31, formed at the upper side of the control panel 25 and communicated with the inside of the electric device room 20 to allow exterior air to enter the inside of the electric device room 20, and a plurality of through-holes 32, formed in the side plate 13 of the cooking chamber 10 such that the air entered through the front suction port 31 cools the inside of the electric device room 20 and enters the cooking chamber 10. Additionally, the ventilation passage includes a plurality of through-holes 33 formed in the upper plate 11 of the cooking chamber 10 to discharge air in the cooking chamber 10 to the outside, and a front discharge port 34 formed at the front upper side of the cooking chamber 10.

Thus, when the cooling fan 23 is driven, air entering the electric device room 20 through the front suction port 31 cools the inside of the electric device room 20 and enters the cooking chamber 10 through the through-holes 32 of the side plate 13 to ventilate the cooking chamber 10 and is discharged to the exterior through through-holes 33 of the upper plate 11 and the front discharge port 34.

The discharging passage includes a suction port for discharge use 41 formed in the bottom plate 1*a* of the main body 1, a lower passage 42 defined by a space formed between the cooking chamber 10 and the electric device room 20 and the bottom plate 1 a of the main body, two upward passage 43 and 44 respectively formed at the outer side of the side plate 13 of the cooking chamber 10 and at the rear side of the electric device room 20, and upper passages 46 and 47 formed at the upper side of the main body 1 to guide gas or smoke guided by the upward passages 43 and 44 to the discharging fan 45. Thus, when the discharging fan 45 is driven, gas or smoke is sucked through the suction port for discharge use 41 and sequentially passes through the lower passage 42, the two upward passages 43 and 44, and the upper passages 46 and 47 and is discharged to the exterior.

Meanwhile, the microwave oven according to an embodiment of the present invention includes a tray assembly for allowing food to be uniformly cooked. Particularly, the microwave oven according to an embodiment of the present invention can be structured such that there is a small difference between time when a linearly traveling tray is positioned the rightmost side or leftmost side of the region, in which the linearly traveling tray travels, and time when the linearly traveling tray travels from the rightmost side to the leftmost side.

Figure 2:
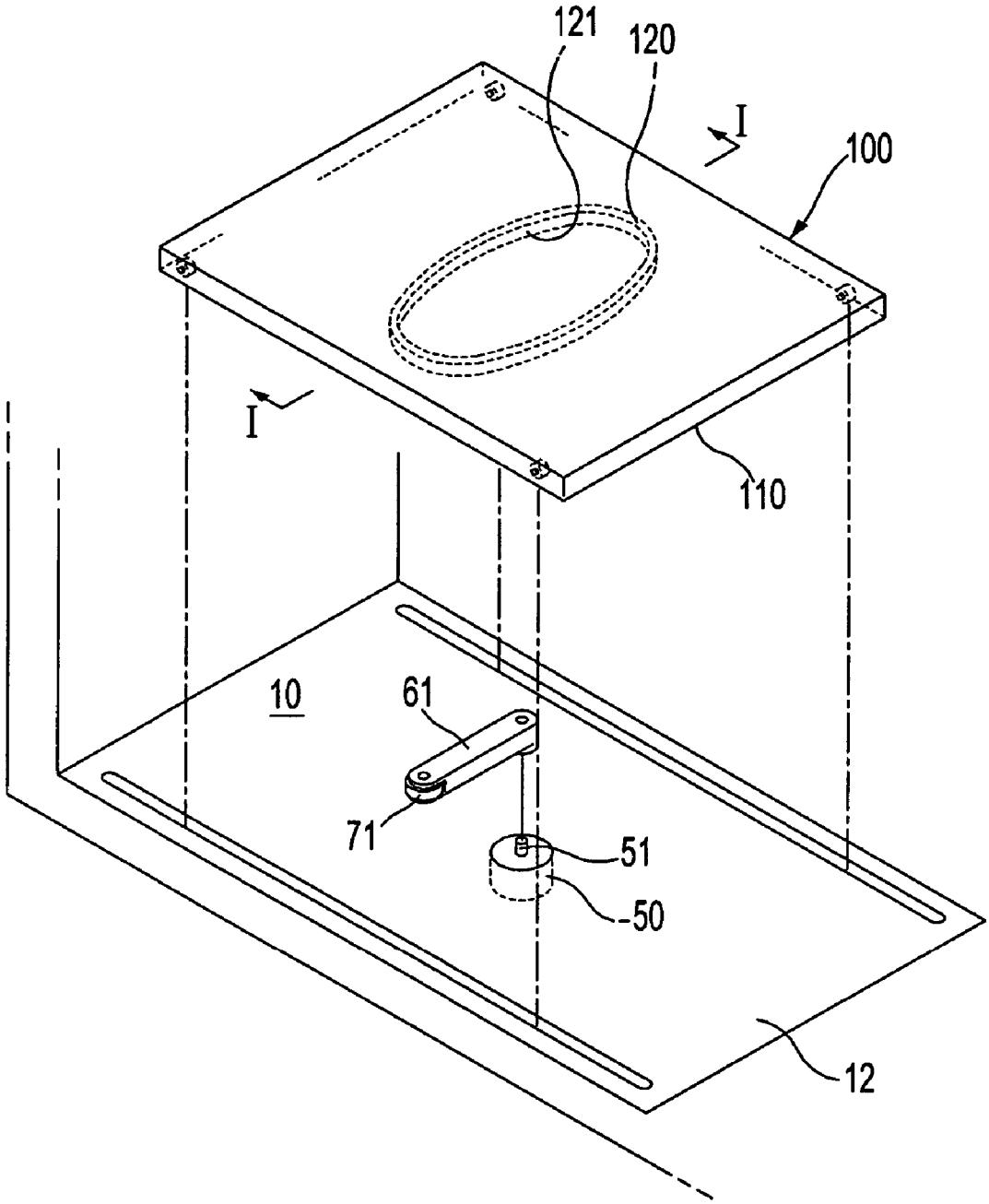
FIG. 2 is an exploded perspective view illustrating the structure of a tray assembly of a microwave oven according to a first embodiment of the present invention.
Figure 3:
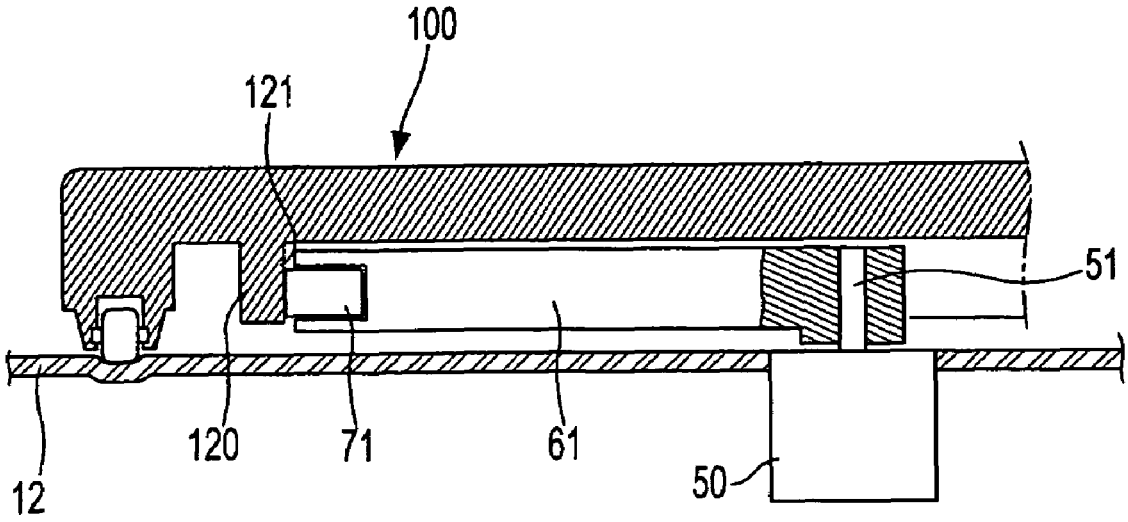
FIG. 3 is a sectional view taken along the line I-I in FIG. 2 when the tray assembly in FIG. 2 is assembled.

FIG. 2 is an exploded perspective view illustrating the structure of a tray assembly of a microwave oven according to a first embodiment of the present invention, and FIG. 3 is a side sectional view taken along the line I-I in FIG. 2 when the tray assembly in FIG. 2 is assembled.

As shown in FIGS. 2 and 3, the tray assembly of the microwave oven according to a first embodiment of the present invention includes a tray 100, which reciprocates to the right and left, on the bottom plate 12 of the cooking chamber, a motor 50 installed at the lower side of the bottom plate 12 of the cooking chamber to supply driving power to the tray 100, and a power transmission for transmitting the movement of the motor 50 to the tray 100.

The tray 100 has an approximately rectangular shape and a guide channel 120 protruded from the lower side 110 to guide the linear movement of the tray 100 together with the power transmission. The guide channel 120 has an oval shape with a major axis in the same direction as the front and rear direction of the cooking chamber 10. The power transmission rotates and moves within the guide channel 120, and contacts the inner surface 121 of the guide channel 120 at a predetermined region to push the tray 100, thereby causing the tray 100 to linearly travel.

Particularly, when the tray 100 reaches the rightmost or leftmost side within the traveling region, the power transmission is separated from the inner surface 121 of the guide channel 120 and freely moves. The oval shape of the guide channel 120 may be designed to allow the free movement region to be 90 degrees. As a result, time when the tray 100 stops at the leftmost side of the cooking chamber 10, time when the tray 100 travels from the left side to the right side, time when the tray 100 stops at the rightmost side, and time when the tray 100 travels from the right side to the left side are equal so that food can be uniformly cooked. When designing the guide channel 120, the free movement region of the power transmission without contacting the inner surface 121 of the guide channel 120 can be adjusted by changing the major axis and minor axis of the guide channel 120. In other words, if the guide channel 120 has an oval shape having a large ellipticity, the free movement region may be shorter, and if the guide channel 120 has an oval shape having a small flatness, the free movement region may be longer.

As shown in FIGS. 2 and 3, the power transmission may include a linkage 61 having a side coupled with a rotation shaft 51 of the motor 50 and the other side contacting the inner surface 121 of the guide channel 120. The linkage 61 may include a roller 71 provided at the end thereof contacting the inner surface 121 of the guide channel 120 such that driving power is smoothly transmitted. Although the linkage 61 having the roller 71 is depicted in FIGS. 2 and 3, since the roller 71 is an optional member, the linkage 61 can directly contact the inner surface 121 of the guide channel 120 without the roller 71.

Figure 4:
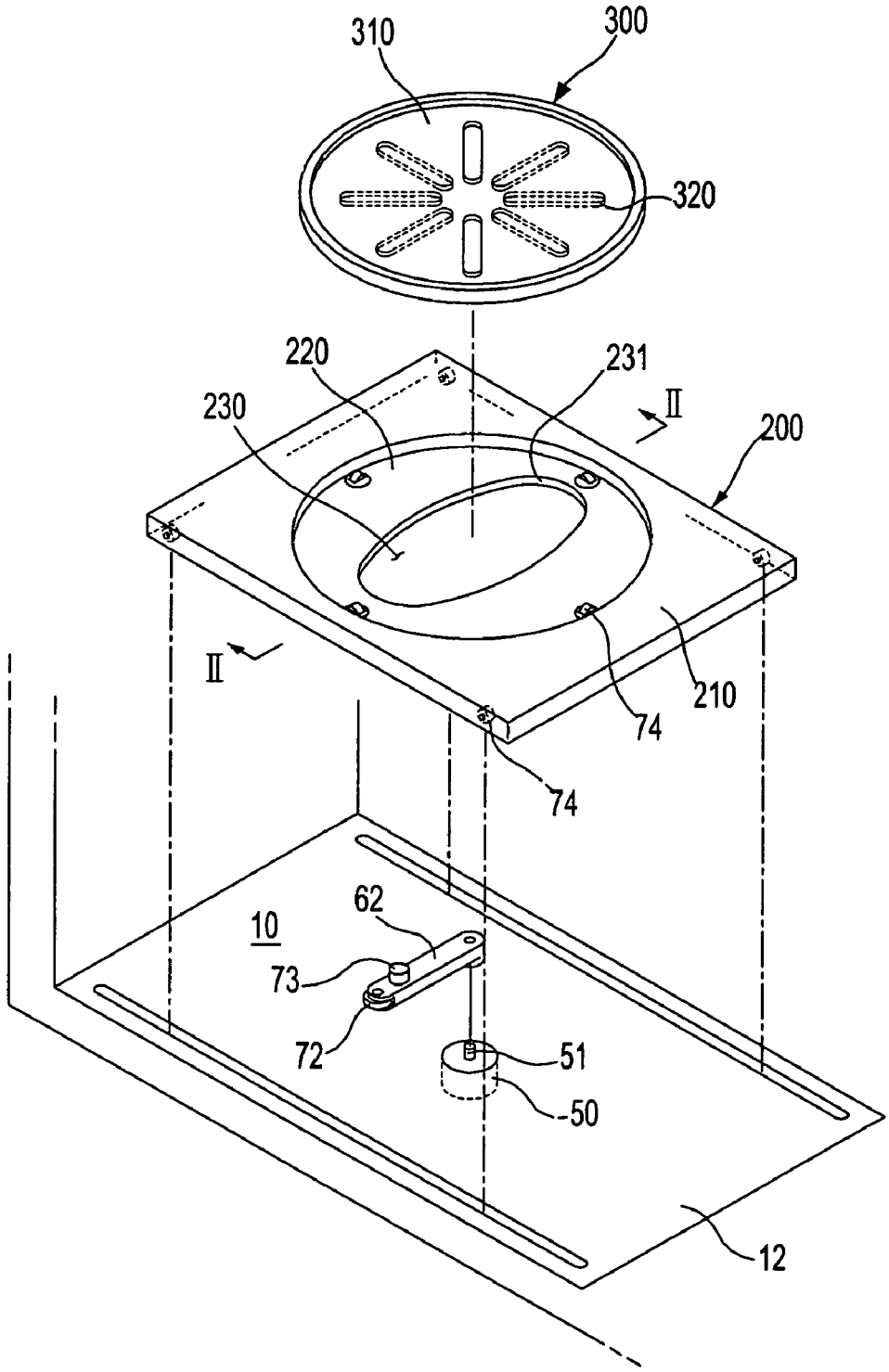
FIG. 4 is an exploded perspective view illustrating the structure of a tray assembly of a microwave oven according to a second embodiment of the present invention.
Figure 5:
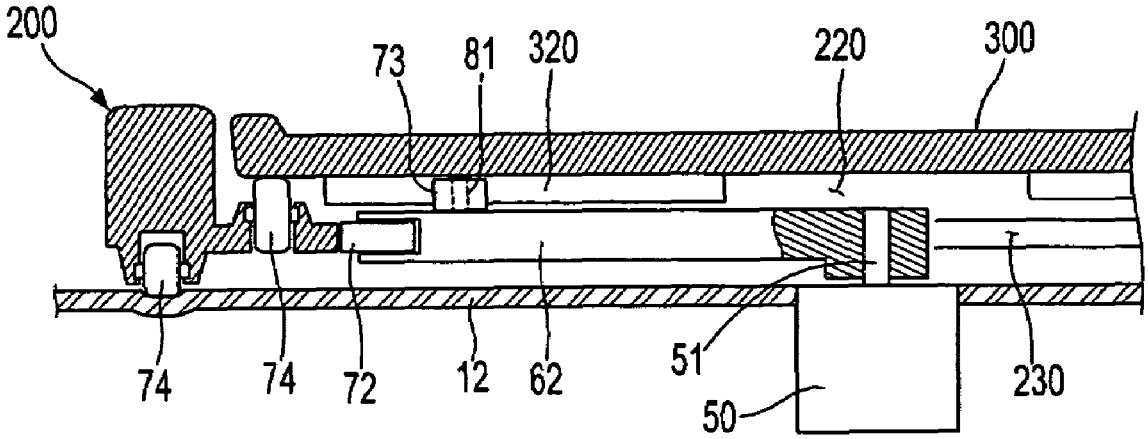
FIG. 5 is a sectional view taken along line II-II in FIG. 4 when the tray assembly in FIG. 4 is assembled.

FIG. 4 is an exploded perspective view illustrating the structure of a tray assembly of a microwave oven according to a second embodiment of the present invention and FIG. 5 is a sectional view taken along the line II-II in FIG. 4 when the tray assembly in FIG. 4 is assembled.

As shown in FIGS. 4 and 5, a tray assembly of the microwave oven according to a second preferred embodiment of the present invention includes a first tray 200 linearly traveling on the bottom plate of the cooking chamber, a second tray 300 placed on the upper side of the first tray 200 to rotate, a motor 50 for supplying driving power to the first and second trays 200 and 300, and a power transmission for transmitting driving power of the motor 50 to the first and second trays 200 and 300.

The first tray 200 has an approximately rectangular shape, and an accommodating part 220 formed in the upper side 210 of the first tray 200 such that the second tray 300 is accommodated and rotated in the accommodating part 220. The accommodating part 220 may have a depth by which, when the second tray 300 is placed therein, the upper side 310 of the second tray 300 is positioned lower than the upper side 210 of the first tray 200. As a result, when long food is cooked on the first tray 200, the long food can be cooked without colliding against the rear plate 14 of the cooking chamber or the inner surface of the door 2 due to the rotation of the second tray 300.

In the central region of the accommodating part 220, a guide hole 230 is formed to guide the linear movement of the first tray 200 in association with the power transmission. The guide hole 230, like the guide channel 120, has an oval shape having a major axis in the same direction as the front and rear direction of the cooking chamber 10, and the power transmission rotates within the guide hole 230 and contacts the inner surface 231 of the guide hole 230 at a region to push the first tray 200 to linearly move. Since details of the design of the guide hole 230 are similar to those of the guide channel 120, a detailed description thereof is omitted.

The power transmission for transmitting driving power of the motor 50 to the first tray 200 may include a linkage 62 having an end coupled with the rotation shaft 51 of the motor 50 and the other end thereof contacting the inner surface 231 of the guide hole 230. The linkage 62 may include a roller 72 provided at the end contacting the inner surface 231 of the guide hole 230 to smoothly transmit driving power. Although FIGS. 4 and 5 depict the linkage 62 as including the roller 72, since the roller 72 is an optional member, the linkage 62 can directly contact the inner surface 231 of the guide hole 230 without the roller 72.

The second tray 300 is made in the shape of a disc and is installed to rotate in the accommodating part 220 of the first tray 200. In the lower surface of the second tray 300, at least one locking step 320 is protruded downward. The locking step 320 extends in the radial direction to a predetermined length, and the power transmission contacts the side of the locking step 320 and travels in the radial direction to rotate the second tray 300.

The power transmission for transmitting driving power of the motor 50 to the second tray 300 includes the linkage 62 and a protrusion 81 protruded from the linkage 62 upward. The protrusion 81 includes a roller 73 having the protrusion 81 as a rotation shaft such that driving power is smoothly transmitted. Although FIGS. 4 and 5 depict the linkage 62 including the roller 73, since the roller 73 is an optional member, the protrusion 81 can directly contact the side of the locking step 320 without the roller 73.

Due to such structure, in the tray assembly of the microwave oven according to the second embodiment of the present invention, the linkage 62 or the roller 72 contacts the inner surface 231 of the guide hole 230 such that the first tray 200 linearly moves, and the protrusion 81 or the roller 73 contacts the side surface of the locking step 320 such that the second tray 300 rotates.

Meanwhile, the protrusion 81 may be detachable from the linkage 62. When the protrusion 81 is separated from the linkage 62, since the second tray 300 does not rotate and only the first tray 200 is linearly moved by the linkage 62, even if long food is placed on the first tray 200, the food does not interfere with the rear plate 14 of the cooking chamber or the inner surface of the door 2. Thus, in this case, there is no reason that the upper side 310 of the second tray 300 is positioned lower than the upper side 210 of the first tray 200.

Meanwhile, a guide roller 74 for smoothly moving the first and second trays 200 and 300 is disposed between the first tray 200 and the bottom plate 12 of the cooking chamber and between the second tray 300 and the first tray 200. Although the guide roller 74, as shown in FIG. 4, may be installed to the first tray, a frame including a roller may be installed between the bottom plate 12 and the first tray 200 or between the first tray 200 and the second tray 300.

Figure 6:
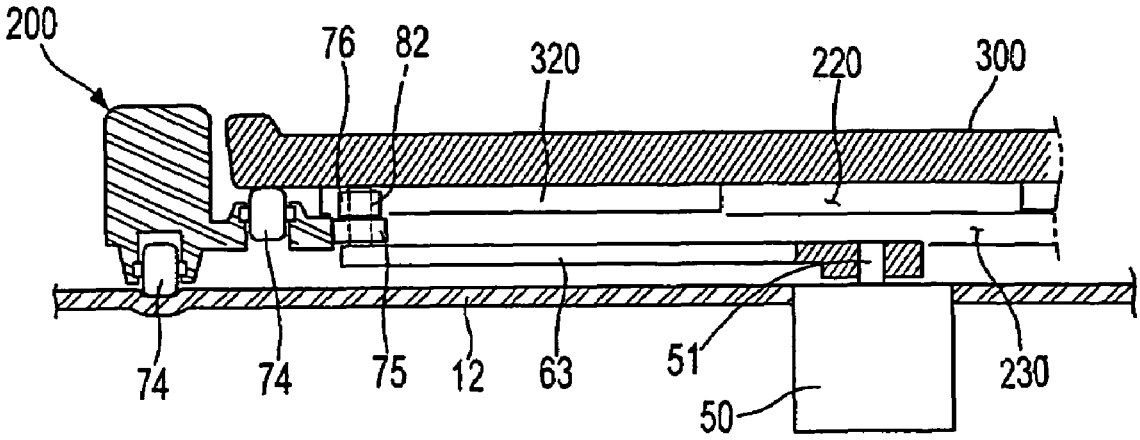
FIG. 6 is sectional view illustrating the structure of a tray assembly of a microwave oven according to a third embodiment of the present invention.

FIG. 6 is sectional view illustrating the structure of a tray assembly of a microwave oven according to a third embodiment of the present invention. In the third embodiment, the power transmission of the tray assembly of the second embodiment is modified.

As shown in FIG. 6, the power transmission of the tray assembly of the microwave oven according to the third embodiment includes a linkage 63 having an end coupled with the rotation shaft of the motor and a protrusion 82 protruded from the linkage 63 upward. The protrusion 82 may include rollers 75 and 76 adopting the protrusion 82 as a rotation shaft such that driving power is smoothly transmitted. Although FIG. 6 depicts the protrusion 82 including the rollers 75 and 76, since the rollers 75 and 76 are optional members, the protrusion 82 can directly contact the first tray 200 without the rollers 75 and 76.

In this power transmission, the protrusion 82 or the roller 75 contacts the inner surface 231 of the guide hole 230 to linearly move the first tray 200, and if the protrusion 82 extends to the bottom surface of the second tray 300, the protrusion 82 or the roller 76 contacts the locking step 320 to rotate the second tray 300.

Figure 7:
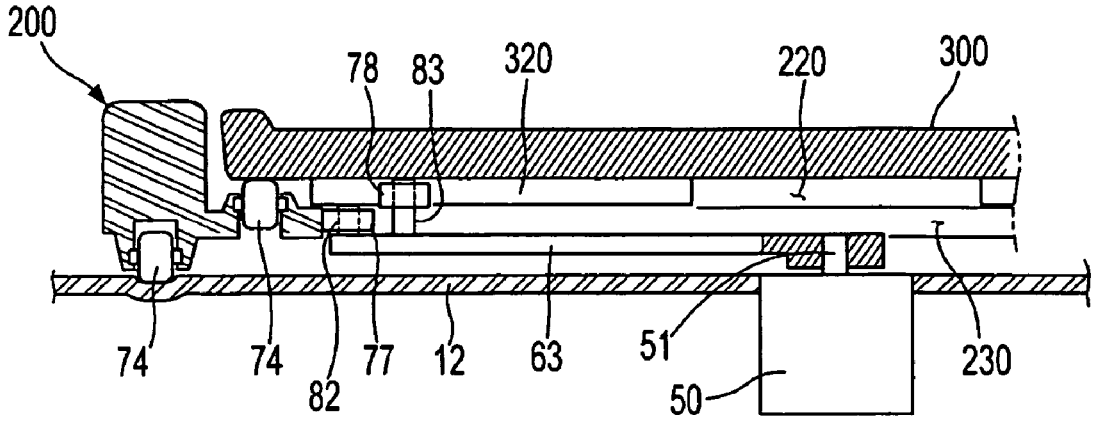
FIG. 7 is a sectional view illustrating the structure of a tray assembly of a microwave oven according to a fourth embodiment of the present invention.

FIG. 7 is a sectional view illustrating the structure of a tray assembly of a microwave oven according to a fourth embodiment of the present invention. The fourth embodiment of the present invention is a modification of the power transmission of the tray assembly in the second embodiment of the present invention.

As shown in FIG. 7, the power transmission of the tray assembly of the microwave oven according to the fourth embodiment of the present invention further includes a second protrusion 83 protruded from the linkage 63 upward such that the second protrusion 83 contacts the locking step 320 to transmit driving power to the second tray 300. In other words, in this fourth preferred embodiment, the second protrusion 83 is independent of the protrusion 82 for transmitting driving power to the first tray 200. The protrusion 82 and the second protrusion 83 may include rollers 77 and 78 respectively adopting the protrusion 82 and the second protrusion 83 as a rotation shaft such that driving power is smoothly transmitted. Although the power transmission includes the rollers 77 and 78 in FIG. 7, the rollers 77 and 78 are optional members, the protrusion 82 and the second protrusion 83 can directly contact the first tray 200 without the rollers 77 and 78.

In this power transmission, the protrusion 82 or the roller 77 contacts the inner surface 231 of the guide hole 230 to linearly move the first tray 200, and the second protrusion 83 or the roller 78 contacts the locking step 320 to rotate the second tray 300.

Here, the second protrusion 83 is detachable from the linkage 63 like the description in the second embodiment.

FIGS. 8A-8F are plan views illustrating operation of the tray assembly of the microwave oven according to the embodiment of the present invention. Hereinafter, the microwave oven including a tray assembly according to the third embodiment of the present invention will be described, the same principle may be applied to the microwave oven according to other embodiments of the present invention.

Figure 8A:
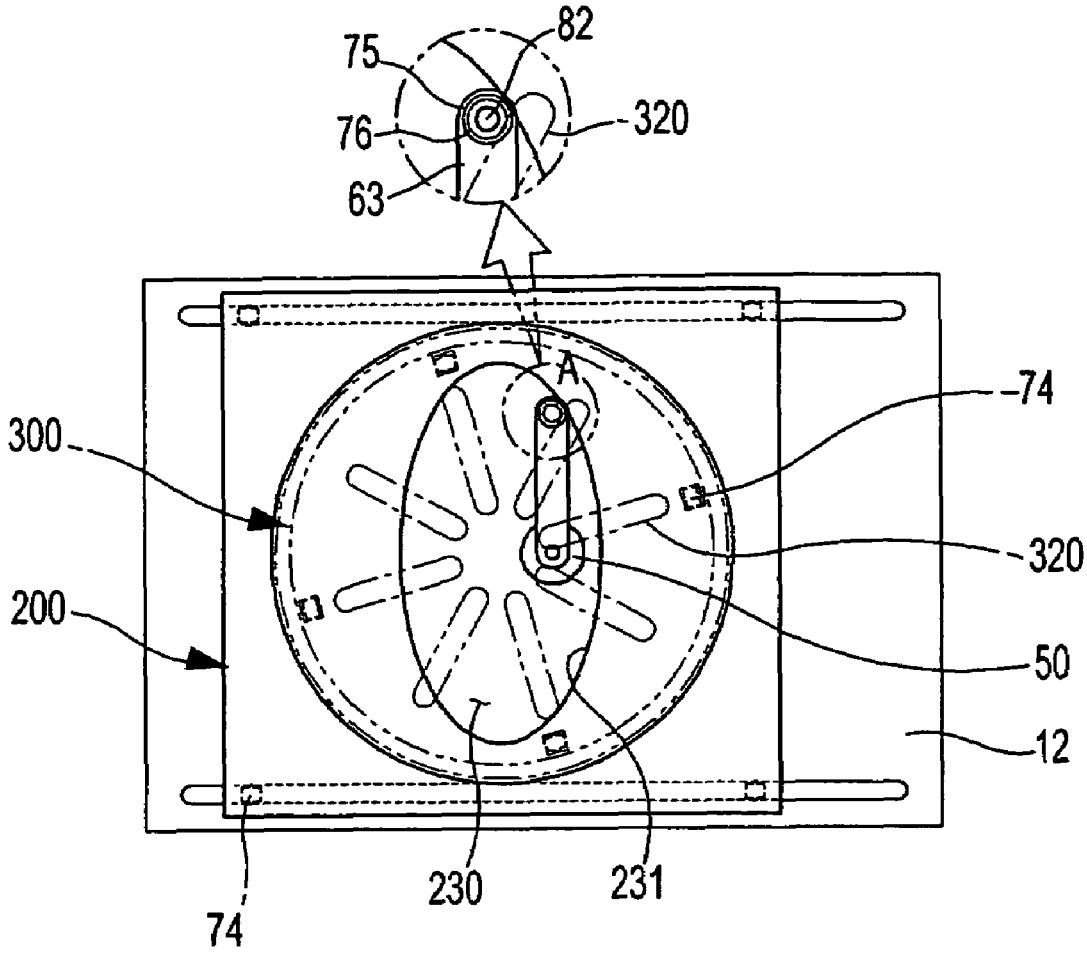
FIGS. 8A-8F are plan views illustrating operation of the tray assembly of the microwave oven according to the third embodiment of the present invention.
Figure 8B:
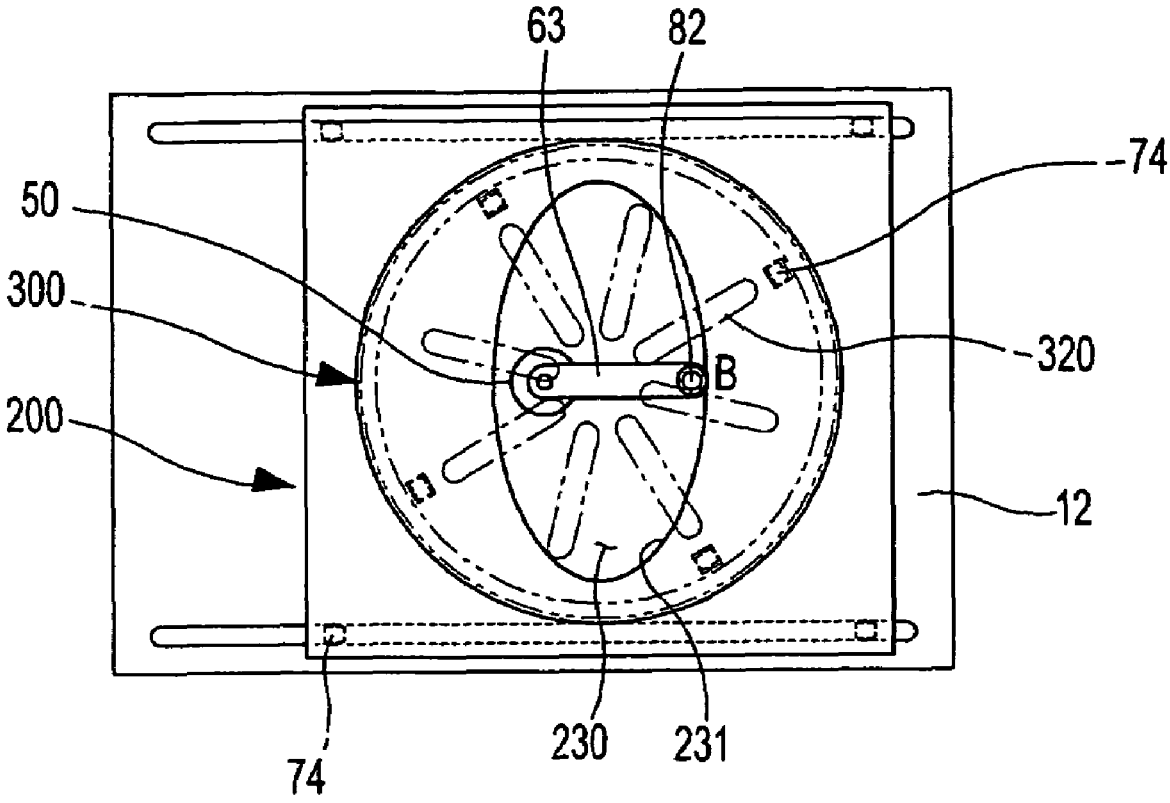
Figure 8C:
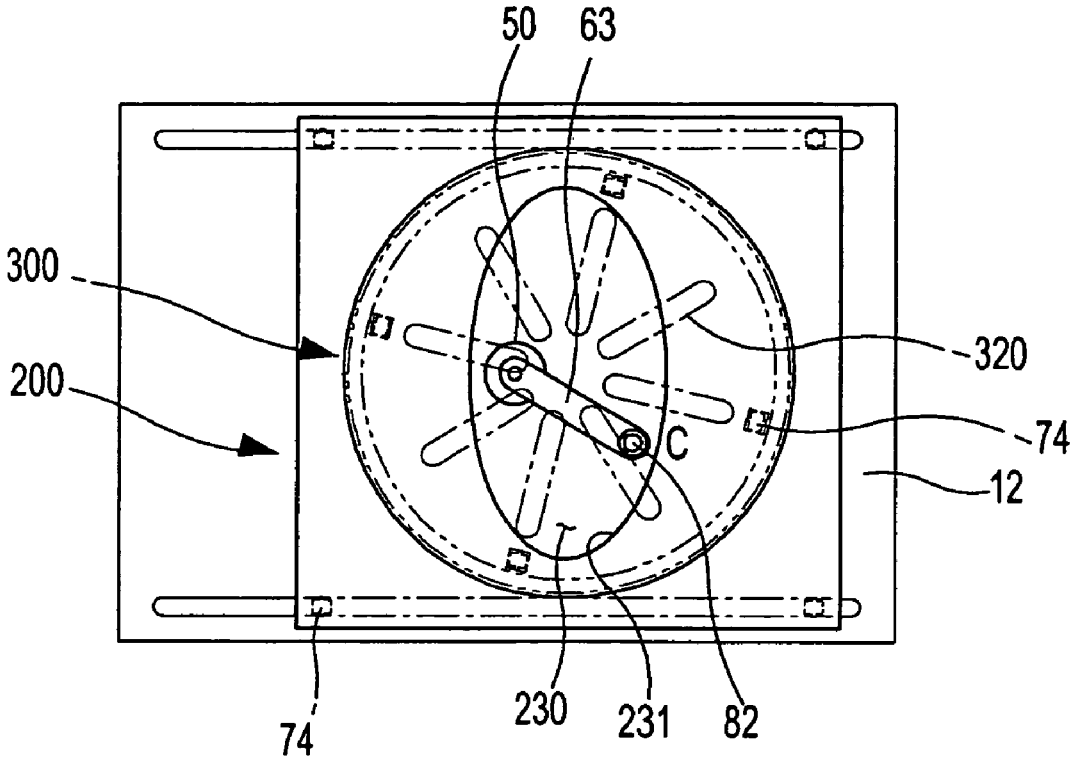
Figure 8D:
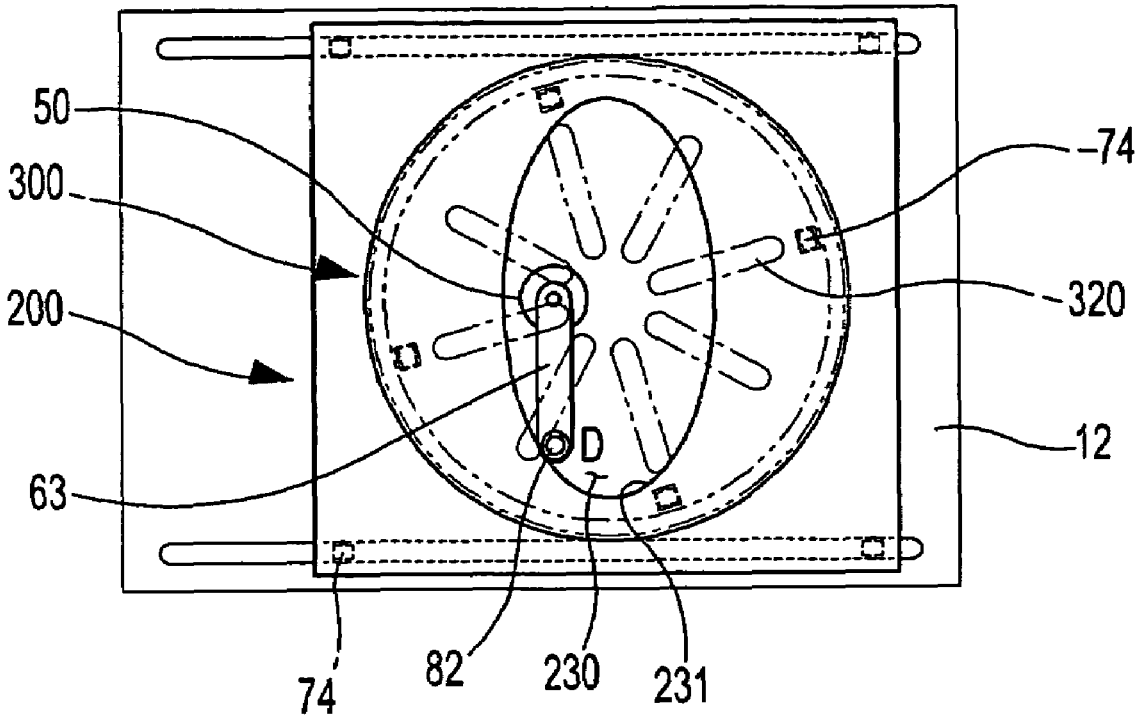
Figure 8E:
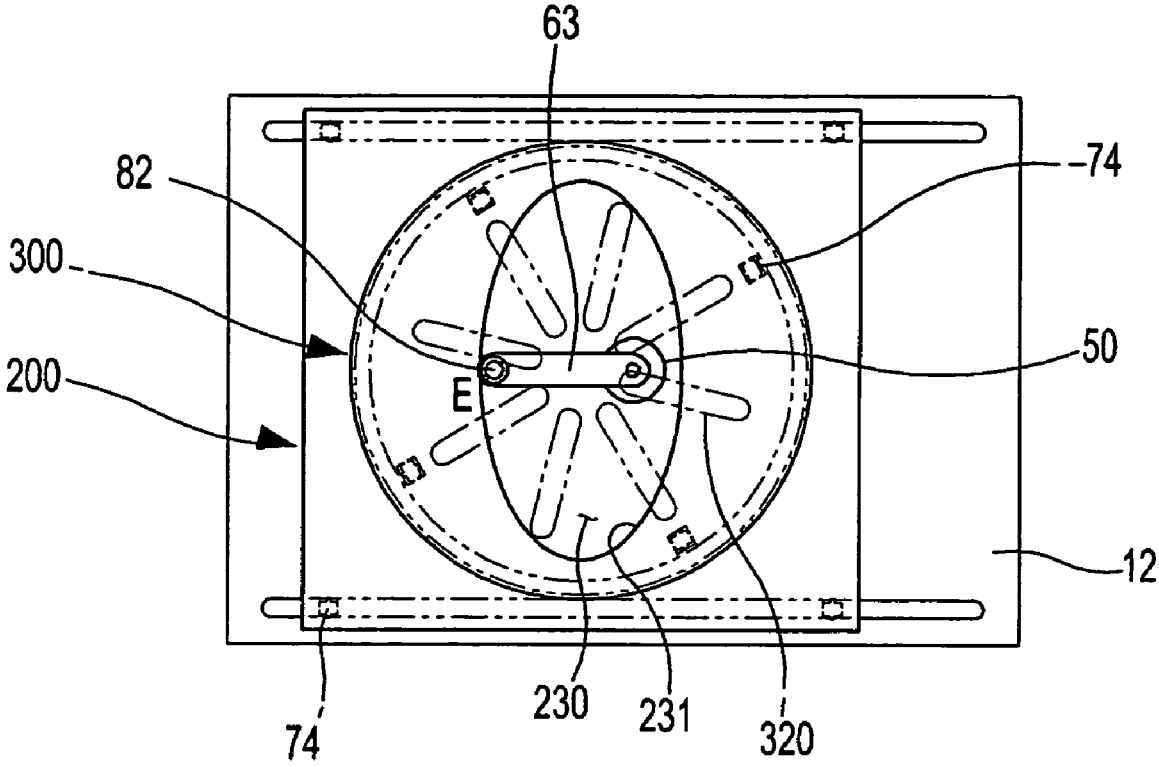
Figure 8F:
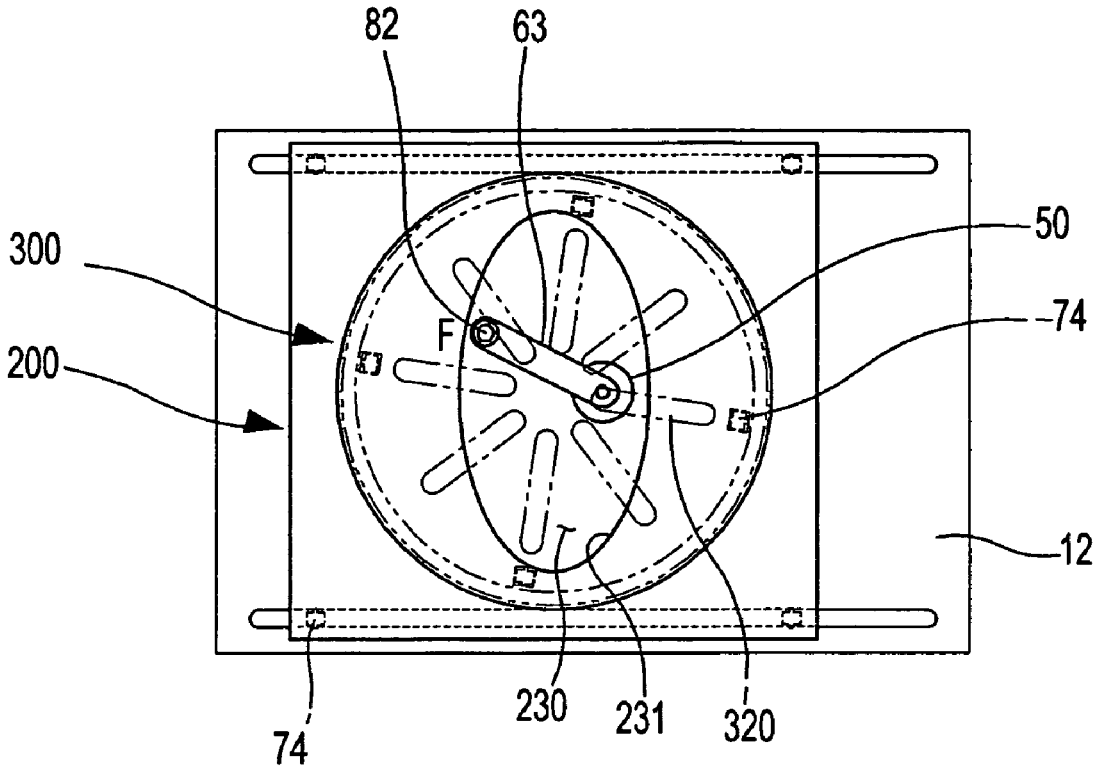

In detail, FIG. 8A is a view illustrating when the first tray 200 positioned at the leftmost side in the traveling region starts to move right, FIG. 8B is a view illustrating when the first tray has reached the rightmost side, and FIG. 8C is a view illustrating when the roller 75 is separated from the inner surface 231 of the guide hole 230 so that the first tray 200 does not move and only the roller 75 rotates. Moreover, FIG. 8D is a view illustrating when the roller 75 contacts the inner surface 231 of the guide hole 230 again and the first tray 200 starts to move left, FIG. 8E is a view illustrating when the first tray 200 has reached the leftmost side in the traveling region again, and FIG. 8F is a view illustrating when the roller 75 is separated from the inner surface 231 of the guide hole 230 so that the first tray 200 does not move and the only roller 75 rotates.

As shown in FIGS. 8A-8F, only within the region where the roller 75 fitted around the protrusion 82 contacts the guide hole 230, the region A-B, and the region D-E, the first tray 200 moves to the left side or the right side, and in the regions B-D and E-A where the roller 75 does not contact the guide hole 230, the first tray 200 does not move but stops for a predetermined time. However, since, in the regions B-D and E-A, the first tray 200 is positioned at the rightmost side or at the leftmost side, the first tray 200 stops at the rightmost side or at the leftmost side for a determined time and moves again. The time, when the first tray 200 stops, can be adjusted by changing the configuration of the guide hole 230.

As described above, according to the present invention, time when the linearly traveling tray is positioned at the leftmost side or at the rightmost side in the traveling region of the tray is adjusted such that the difference between the time when the linearly traveling tray is positioned at the right or left side of the cooking chamber and time when the tray travels between the right side and the left side is significantly small, thereby cooking food placed at any position in the cooking chamber uniformly.

Moreover, since the first tray is not easily separated from the power transmission, the tray assembly is steadily driven.

Additionally, since the first tray, the second tray, and the power transmission are conveniently assembled, a user can clean the assembly and easily reinstall the same.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A microwave oven comprising:

a cooking chamber having a bottom plate;

a tray linearly traveling in the cooking chamber between a first position corresponding to a leftmost position in the cooking chamber and a second position corresponding to a rightmost position in the cooking chamber;

a motor generating driving power necessary for the travel of the tray;

a power transmission transmitting the driving power to the tray; and a guide channel protruded from the bottom surface of the tray to guide the linear travel of the tray;

wherein the power transmission contacts with an inner surface of the guide channel in a region to move the tray in the right and left directions, and is separated from the inner surface of the guide channel when the tray reaches the first position or the second position, to allow the tray to stop at the first position or the second position for a predetermined time.

2. The microwave oven according to claim 1, wherein the power transmission contacts the guide channel to move the tray to the rightmost side or to the leftmost side while rotating by 90 degrees, and freely moves while rotating by 90 degrees again.

3. The microwave oven according to claim 1, wherein the power transmission comprises a linkage including an end coupled with a rotation shaft of the motor and the other end contacting the inner surface of the guide channel.

4. The microwave oven according to claim 3, wherein the linkage comprises a roller installed at an end contacting the inner surface of the guide channel.

* * * * *